US005677843A

United States Patent [19]

Mizuno et al.

[11] Patent Number: 5,677,843

[45] Date of Patent: Oct. 14, 1997

[54] EMBROIDERY DATA STORING DEVICE

[75] Inventors: Masahiro Mizuno; Masao Futamura; Yukiyoshi Muto, all of Nagoya, Japan

[73] Assignee: Brother Kogyo Kabushiki Kaisha, Nagoya, Japan

[21] Appl. No.: 394,637

[22] Filed: Feb. 27, 1995

[30] Foreign Application Priority Data

May 20, 1994 [JP] Japan ..... 6-106507

[51] Int. Cl.[6] ..... G06F 19/00

[52] U.S. Cl. ..... 364/470.09; 112/475.19

[58] Field of Search ..... 364/470, 191–193, 364/474.22–474.27, 470.07–470.09; 395/442; 112/453, 454, 457, 475.19, 102.5; 235/375

[56] References Cited

U.S. PATENT DOCUMENTS 4,899,287 2/1990 Hulshoff et al. ..... 364/470

5,343,401 8/1994 Goldberg et al. ..... 364/470

5,408,633 4/1995 Katsumura et al. ..... 395/442

*Primary Examiner*—Reba I. Elmore

*Assistant Examiner*—Steven R. Garland

*Attorney, Agent, or Firm*—Oliff & Berridge

[57] ABSTRACT

All embroidery data in a flash memory card are copied to a RAM, and file numbers of the embroidery data copied to the RAM are displayed on a LCD. When the user selects the embroidery data to be erased, the data are erased from the RAM and the LCD. When the selection of the data to be erased is over and an end key is pressed, the flash memory card is initialized, and thereafter the remaining embroidery data left on the RAM are copied to the flash memory card. Accordingly, the operation of rewriting the data in the flash memory card is completed at one time, with the result that the rewriting time required for the erasing of plural embroidery data can be greatly reduced.

14 Claims, 5 Drawing Sheets

EMBROIDERY DATA STORING DEVICE

BACKGROUND OF THE INVENTION

1. Field of the Invention

The invention relates to an embroidery data storing device allowing a storage medium to store embroidery data for embroidery to be made on clothes, cloth, etc., the data having been generated by an apparatus such as a computer and an embroidery data generating device.

2. Description of the Related Art

Generally known is an embroidery data storing device allowing a storage medium such as a floppy disk and a memory card to store embroidery data generated by an apparatus such as a computer or an embroidery data generating device. The storage medium into which the embroidery data is stored by the embroidery data storing device is loaded into an embroidery machine to supply the embroidery data to the embroidery machine. The embroidery machine makes embroidery according to the embroidery data.

When the remaining capacity of the storage medium in such an embroidery data storing device for storing embroidery data is insufficient in comparison with the quantity of the embroidery data to be written into the storage medium, the user must erase unnecessary data from a plurality of embroidery data previously stored in the storage medium and then execute an instruction of writing of the embroidery data to be written to the embroidery data storing device. The erasing of the data is performed every time the embroidery data to be erased is selected from the storage medium.

However, according to such a data erasing process wherein the access to the storage medium is performed every time the embroidery data to be erased is selected, the operation efficiency is very low. That is, much access time is required using a storage medium such as a floppy disk.

SUMMARY OF THE INVENTION

An object of the invention is to provide an embroidery data storing device which can reduce the time required for the erasing process for embroidery data stored in a storage medium.

In order to attain the above object, an embroidery data storing device according to the invention comprising a storage medium for storing a plurality of embroidery data; erase data selecting means for selecting a plurality of embroidery data to be erased from the plurality of embroidery data stored in the storage medium; virtually erasing means for virtually erasing the embroidery data selected by the erase data selecting means; erase instructing means for instructing to actually erase the embroidery data virtually erased by the virtually erasing means; and collectively erasing means for collectively erasing all of the embroidery data virtually erased by the virtually erasing means when an erase instruction is made by the erase instructing means.

According to the embroidery data storing device of the invention, the virtually erasing means virtually erases the embroidery data selected by the erase data selecting means from the plurality of embroidery data stored in the storage medium. The erase data selecting means can select a plurality of embroidery data. When the erase instructing means provides the instruction of actually erasing the embroidery data virtually erased, the collectively erasing means collectively erases from the storage medium all embroidery data virtually erased by the virtually erasing means.

As is apparent from the above description, according to the embroidery data storing device of the invention, a plurality of embroidery data to be erased are selected from the embroidery data stored in the storage medium, and thereafter the embroidery data thus selected are collectively erased. Accordingly, as compared with the conventional storing device wherein every time one embroidery data to be erased is selected, the erase processing is performed, the invention has an advantage that the erase operation can be made efficient.

BRIEF DESCRIPTION OF THE DRAWINGS

A preferred embodiment of the invention will be described in detail with reference to the following figures, wherein.

DETAILED DESCRIPTION OF THE PREFERRED EMBODIMENTS

In the invention, a flash memory is used as a storage medium for embroidery data. The flash memory is a kind of nonvolatile semiconductor memory. Unlike a conventional RAM, the flash memory does not require a power supply to retain stored data. Furthermore, unlike a floppy disk and a hard disk, the flash memory has no drive portion. Therefore, there is less risk of physical damage. The invention is characterized by the use of such a flash memory having the above advantages as a storage medium for embroidery data.

However, the flash memory has a defect in that data rewriting is difficult unlike a usual RAM. That is, data cannot be directly rewritten in the flash memory. Accordingly, in rewriting data, it is necessary to initialize the flash memory and thereafter write new data into the flash memory. In addition, the writing of data cannot be performed by one byte as a unit, but must be performed by one block as a unit. While the size of one block varies according to each flash memory, it is set to 128K bytes in this preferred embodiment. Further, the reading of data must also be performed by one block as a unit.

Accordingly, the rewriting of data in the flash memory is necessarily performed in the following manner. First, the data currently stored by one block as a unit is read from the flash memory and is then copied to a RAM or the like. Secondly, a writing area of the flash memory is initialized by one block as a unit. After the initialization of the flash memory, the data copied to the RAM is rewritten to data intended to be newly written into the flash memory. Then, the data thus rewritten in the RAM is written back to the flash memory.

Thus, although the flash memory as a storage medium for embroidery data has the advantages that no battery is required for storage and there is less risk of physical damage, as mentioned above, it is necessary to repeat the above procedure by the number of data to be erased in erasing a plurality of data stored in the flash memory, causing an increase in time required for the erase processing.

The invention has solved such a problem, and it is an object of the invention to provide an embroidery data storing device which can efficiently perform the erase processing of data in a short time even in the case of using a flash memory as a storage medium for embroidery data.

There will now be described a preferred embodiment of the embroidery data storing device according to the invention with reference to FIGS. 1 to 5 in which the invention is applied to an embroidery data generating device for a home embroidery machine.

Figure 1:
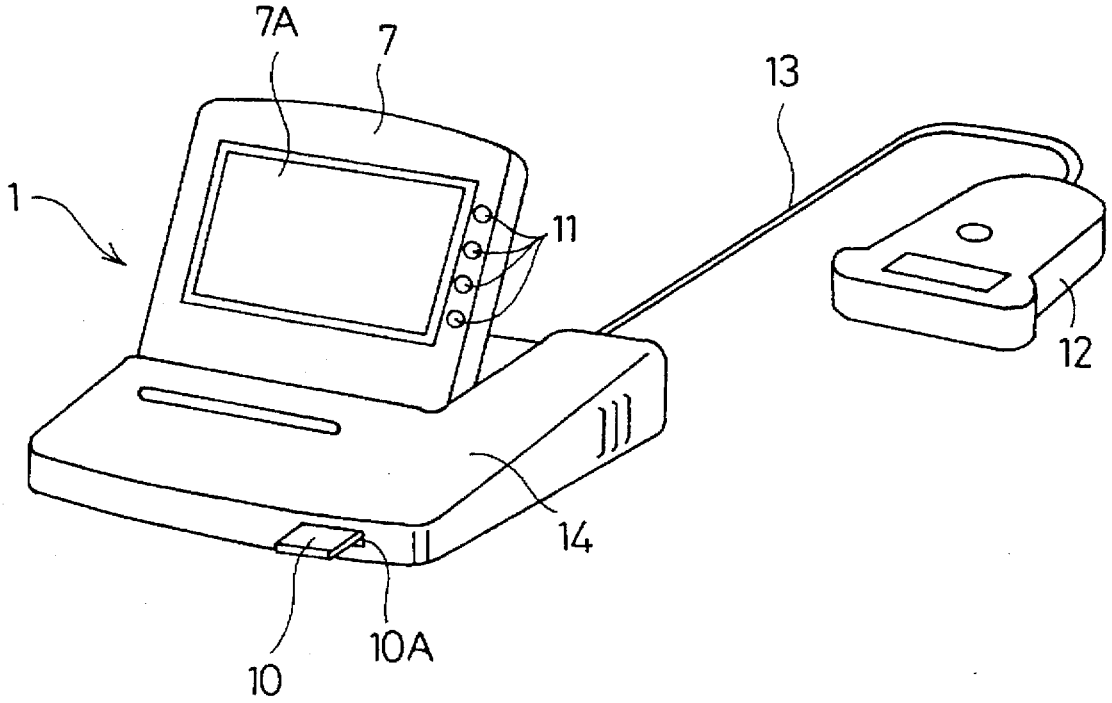
FIG. 1 is a perspective view showing the appearance of an embroidery data generating device as an example of an application of the embroidery data storing device of the invention.

FIG. 1 shows a type of embroidery data generating device. The embroidery data generating device is composed of a body 1 and an image scanner 12 connected to the body 1 through a cord 13 containing a set of signal lines. The image scanner 12 is an image reading device for reading an embroidery image as pattern image data of an original picture that forms the basis for an embroidery pattern. Each pixel of the embroidery image read by the image scanner 12 has a density value of white or black (0 or 1), and is transferred as embroidery data through the cord 13 to the body 1.

The body 1 has a liquid crystal display 7 and a panel 14 provided on the front side of the liquid crystal display 7. The liquid crystal display 7 is rotatably mounted to the panel 14. A rectangular display screen 7A is formed over substantially the entire surface of the liquid crystal display 7, and four operating keys 11 are provided on the right-hand side of the display screen 7A. The four operating keys 11 serve to execute the corresponding different functions or modes displayed at a right-hand area of the display screen 7A. The display corresponding to each operating key 11 on the display screen 7A is changed according to each mode, and the function of each operating key 11 is also changed correspondingly. A card insertion hole 10A into which a flash memory card 10 can be inserted is formed on the front surface of the panel 14 at a right end portion thereof. The embroidery data read by the image scanner 12 and transferred to the body 1 is stored into a RAM 4 provided in the body 1 and is then stored into the flash memory card 10 loaded into the body 1 by the instruction of registration from the user. The flash memory card 10 is a storage medium.

Figure 2:
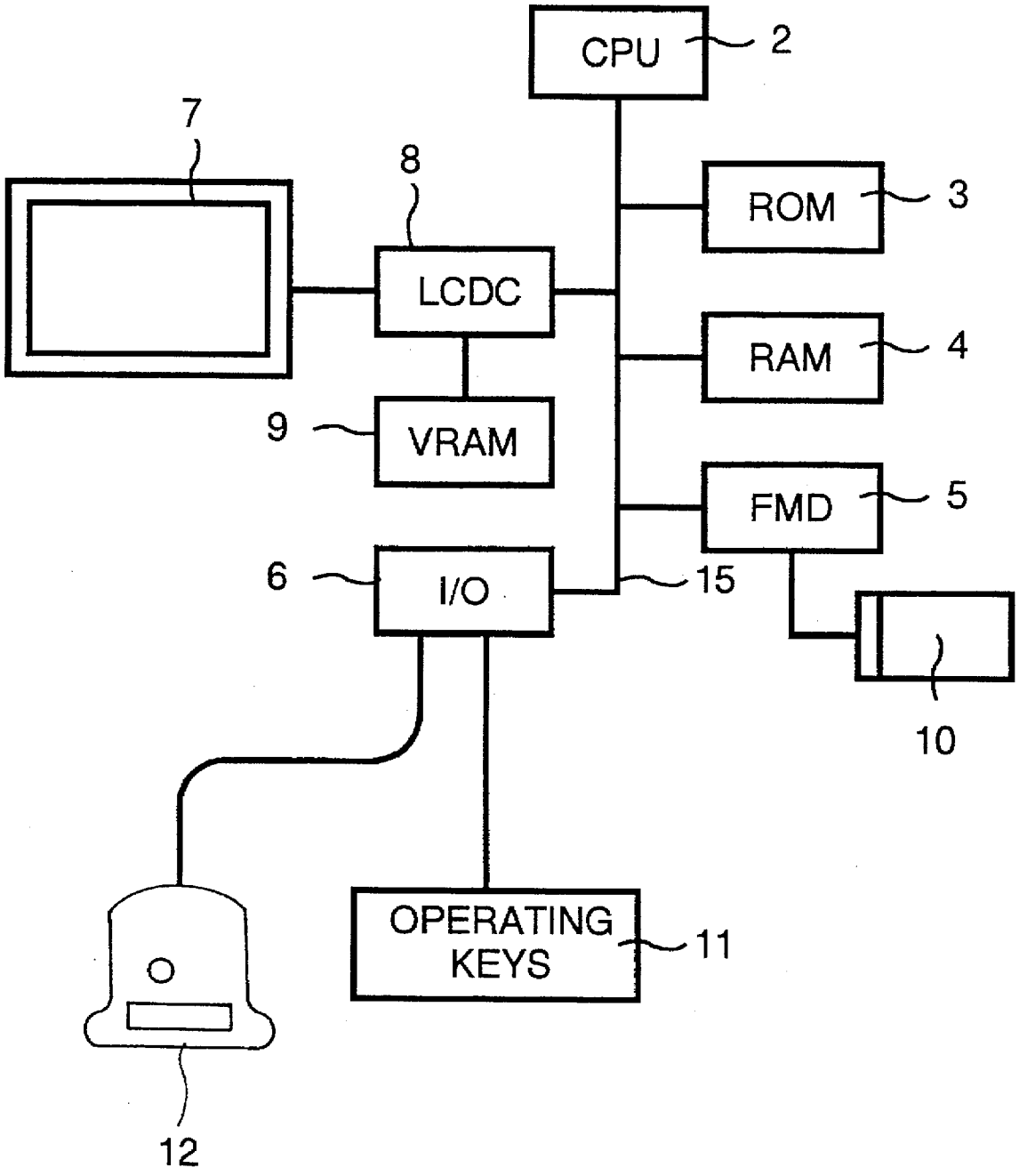
FIG. 2 is a block diagram showing the electrical configuration of the embroidery data generating device in a preferred embodiment of the invention.

FIG. 2 shows the electrical configuration of the embroidery data generating device. The electrical configuration of the embroidery data generating device includes a CPU 2, ROM 3, RAM 4, flash memory device (FMD) 5, input/output interface (I/O) 6, and LCD controller (LCDC) 8, which are connected together through a bus line 15.

The ROM 3 stores a program for performing the control of data erasing processing to be hereinafter described and various other programs. The CPU 2 performs the control according to each program stored in the ROM 3. The RAM 4 has a working memory for storing various data required for the control by the CPU 2 and a data memory for storing the embroidery data.

The flash memory card 10 is removably loaded into the flash memory device 5. The flash memory device 5 is controlled by the CPU 2, and it serves to perform initializing processing to the flash memory card 10 loaded into it and also perform reading and writing of the embroidery data to the flash memory card 10 when loaded. The liquid crystal display 7 and a video RAM (VRAM) 9 are connected to the LCD controller 8. The liquid crystal display 7 is controlled by the LCD controller 8 and data stored in the video RAM 9 is displayed on the display screen 7A. Further, the operating keys 11 and the image scanner 12 are connected through the input/output interface 6 to the CPU 2.

Figure 3:
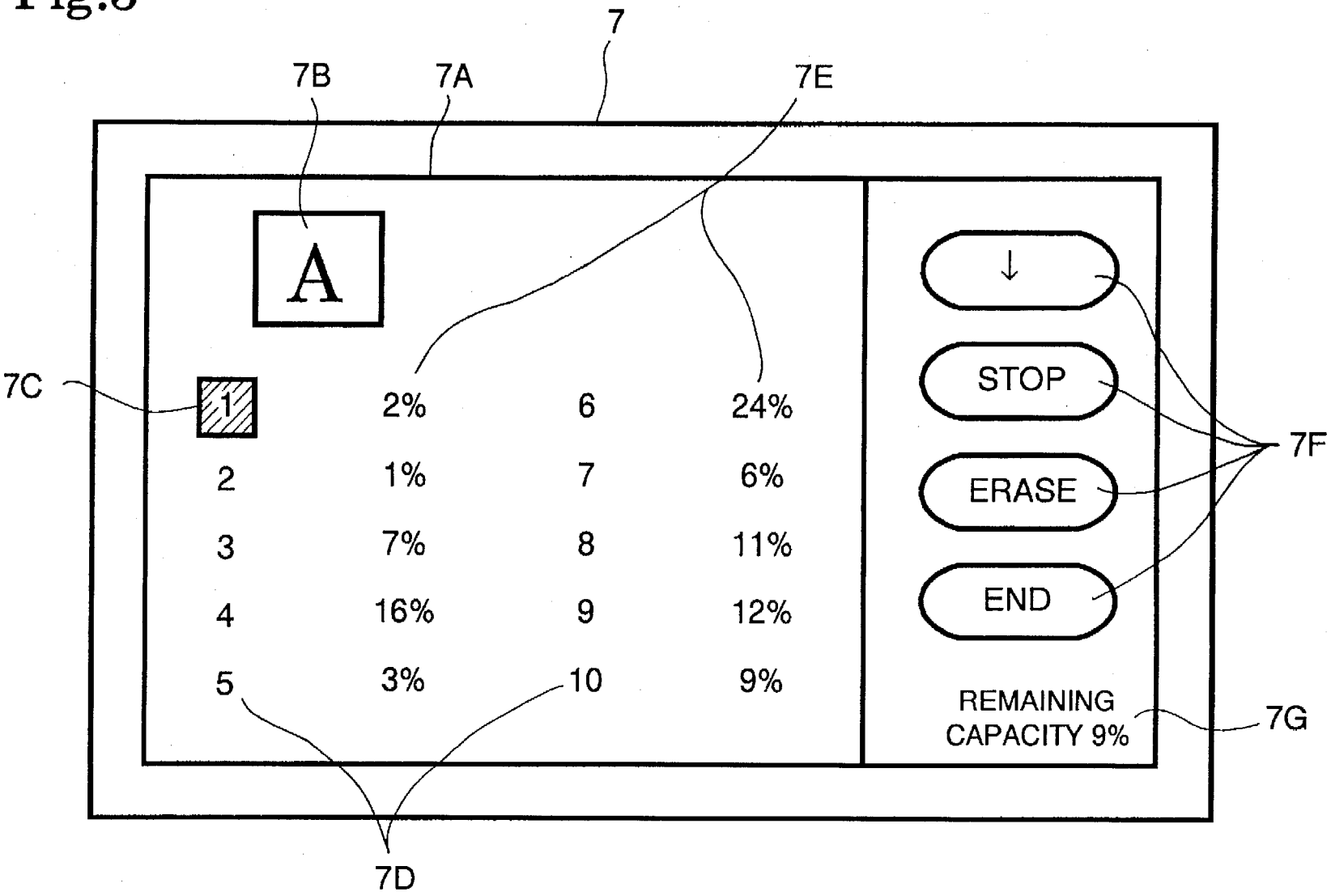
FIG. 3 is a view showing an example of a display on a screen of a liquid crystal display.
Figure 4:
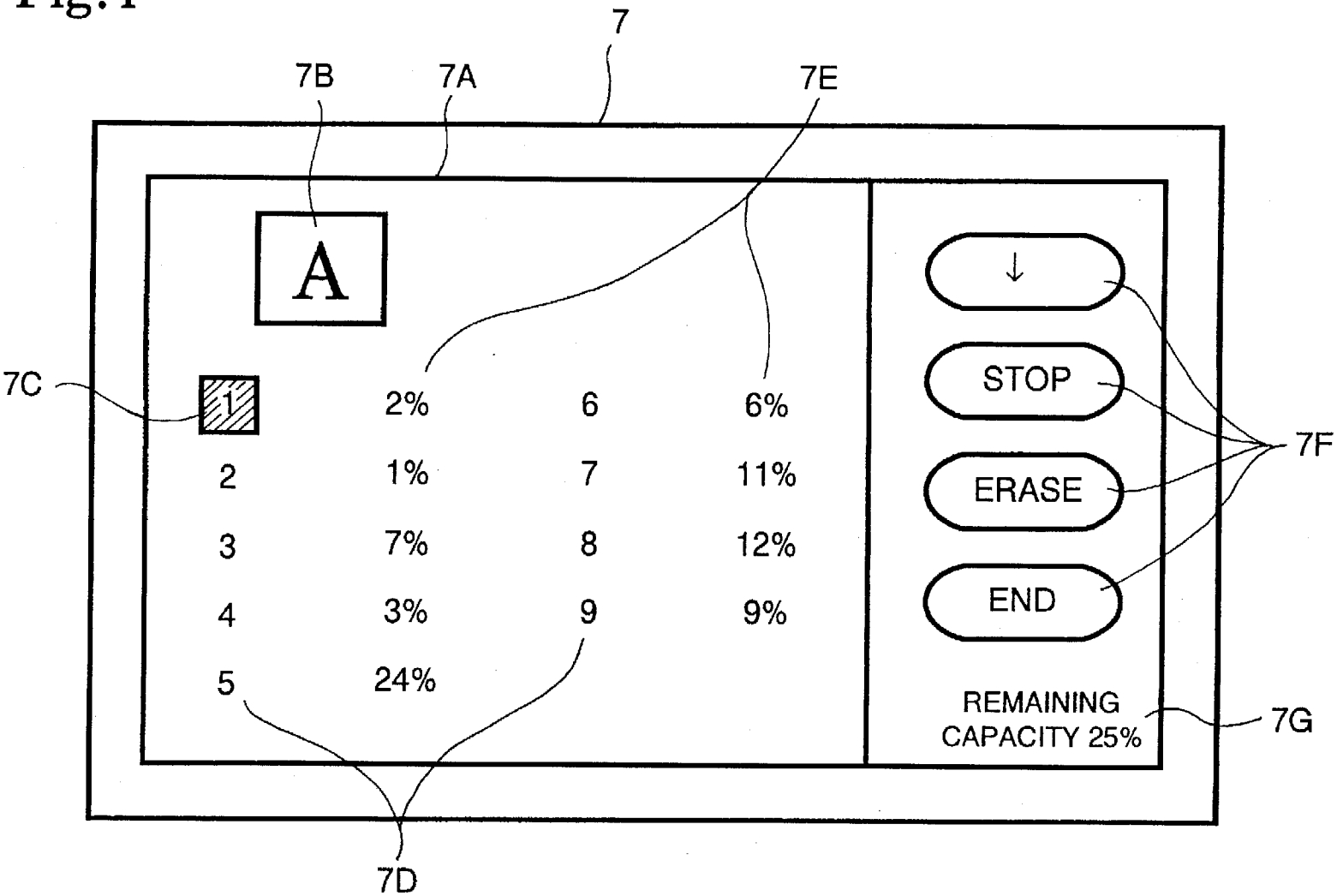
FIG. 4 is a view showing another example of a display on the screen of the liquid crystal display.

FIGS. 3 and 4 show an example of the liquid crystal display 7 in performing the erasing processing to the embroidery data. An exemplary condition of the display screen 7A of the liquid crystal display 7 in performing the erasing processing will now be described with reference to FIGS. 3 and 4.

In a two-third area of the display screen 7A, measured from the left end thereof, the embroidery data stored in the flash memory card 10 is displayed as file numbers 7D with occupied capacities 7E indicated by percentage of the whole storage capacity of the flash memory card 10. A rectangular display area 7B is provided at a left upper portion of the display screen 7A on the upper side of the display area. In the display area 7B, the embroidery data, corresponding to any one of the file numbers 7D, reversely displayed, designated by a cursor 7C, is displayed as an embroidery image in order to inform the user of the contents of the embroidery data designated by the cursor 7C.

Four buttons 7F are displayed on the right-hand side of the display area where the file numbers 7D and the corresponding occupied capacities 7E are displayed. The four buttons 7F are four different kinds of display corresponding to the four operating keys 11, respectively. The contents of the display of the four buttons 7F represent the functions that can be executed by pressing the operating keys 11. Further, a remaining capacity 7G indicated by percentage left in the flash memory card 10 is displayed below the four buttons 7F. The display of the remaining capacity 7G allows the user to determine whether new embroidery data can be stored into the flash memory card 10 without erasing current embroidery data already stored therein.

Figure 5:
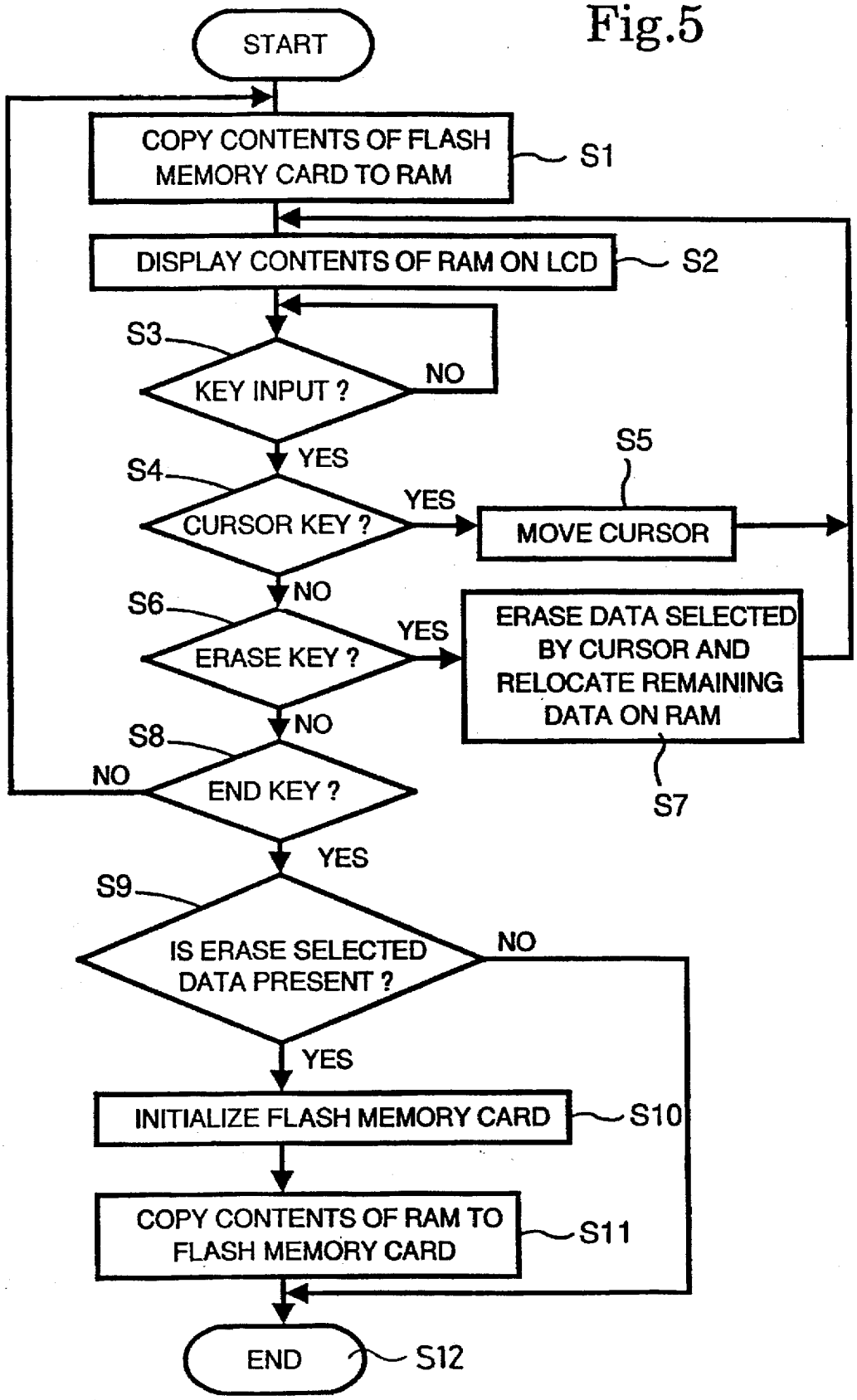
FIG. 5 is a flowchart showing erase processing of embroidery data.

The erasing processing of the embroidery data in the embroidery data generating device according to this preferred embodiment will be described with reference to FIG. 5. When the power supply is turned on and the erasing of the embroidery data is instructed by the user, the embroidery data erasing program stored in the ROM 3 is started by the CPU 2, thus executing the processing shown in FIG. 5.

First, the CPU 2 copies all of the pieces of embroidery data (ten in this example) stored in the flash memory card 10 (step 1 (which will be hereinafter referred to simply as S1; the same shall apply in the other steps)), and displays the contents of the RAM 4 on the liquid crystal display 7 (S2). The condition of the display screen 7A at this time is shown in FIG. 3.

Then, the CPU 2 waits for input from any one of the operating keys 11 (S3: N). When a one of the operating keys 11 is pressed (S3: Y), the following process is executed according to the operating key 11 that is pressed. If the pressed key is a cursor key (S4: Y), the cursor is moved to the next file number displayed to designate the next embroidery data corresponding to the file number (S5), and the program then returns to S2. In this manner, the cursor on the display screen 7A is sequentially moved by repeatedly pressing the cursor key until the embroidery data intended to be erased is selected by the cursor.

If an erase key is pressed after the selection of the embroidery data to be erased by the cursor (S6: Y), the embroidery data selected by the cursor is erased on the RAM 4, and the remaining embroidery data left on the RAM 4 are relocated (S7). For example, if the fourth data shown in FIG. 3 is erased, the fifth to tenth data are shifted forward to be relocated as the fourth to ninth data, respectively. That is, the remaining data are relocated on the RAM 4 as the whole nine continuous data. The condition of the display screen 7A at this time is shown in FIG. 4. This erasing of the embroidery data on the RAM 4 is virtual erasing. After relocating the remaining data, the program returns to S2.

In the same manner, the virtual erasing of any other pieces of embroidery data desired to be erased by the user is performed. Thereafter, if an end key is pressed (S8: Y), the contents of the flash memory card 10 and the contents of the RAM 4 are compared to determine whether there is present any erase selected data, i.e., any virtually erased data (S9). If no embroidery data is selected to be erased by the user (S9: N), the program is ended (S12). On the other hand, if any one of the embroidery data is selected to be erased by the user (S9: Y), a data writing area of the flash memory card 10 is initialized (S10). This initialization is performed according to the characteristics of the flash memory card 10 and it is performed prior to rewriting of the data. After the initialization of the flash memory card 10, the remaining embroidery data now stored in the RAM 4 are copied to the flash memory card 10 (S11). Then, the erasing processing of the embroidery data desired to be erased is ended (S12). The embroidery data virtually erased on the RAM 4 are actually erased by the writing of the remaining embroidery data to the flash memory card 10.

Further, if a stop key is pressed after selecting the erasing of some embroidery data desired and virtually erasing them (S8: N), the program returns to S1 to copy the contents of the flash memory card 10 to the RAM 4 again. Accordingly, the contents of the RAM 4 are rewritten to thereby recover the embroidery data selected to be erased and virtually erased. Thus, the user can correct the erroneous operation of erase selection by pressing the stop key.

The embroidery data storing device provided in the embroidery data generating device according to the above-mentioned preferred embodiment has the following effects. Firstly, when the user selects erasing of the embroidery data, the data is erased on the RAM 4. Accordingly, it seems to the user as if the embroidery data stored in the flash memory card 10 has been erased, so that the subsequent operation is easy to understand. Secondly, after the selection of plural embroidery data to be erased is ended, the embroidery data thus selected are collectively erased from the flash memory card 10. Accordingly, the operation of rewriting the data in the flash memory card 10 is completed at one time, with the result that the rewriting time required for the erasing of plural embroidery data can be greatly reduced. This effect is positive, particularly when a flash memory in which one data as a unit cannot be rewritten is used as a storage medium. That is, when even one data stored in a flash memory is intended to be erased, all data stored in the flash memory must be rewritten regardless of the number of data to be erased.

The invention is not limited to the above-mentioned preferred embodiment, but various modifications may be made without departing from the scope of the invention.

For example, when the embroidery data selected to be erased is virtually erased, the display of the embroidery data thus virtually erased disappears from the liquid crystal display 7 in this preferred embodiment. However, the display of the virtually erased embroidery data may be reversed, underlined, or marked.

Further, in this preferred embodiment, once the embroidery data is selected to be erased, the data selected is erased from the RAM 4 (S7), and the display of the selected data is erased from the liquid crystal display 7 (S2). However, only the display of the embroidery data selected to be erased may be erased from the display screen 7A with the embroidery data being left on the RAM 4.

Likewise, although the selected data is described as being erased from the RAM 4 one piece of data at a time, that is the embroidery data for one pattern is erased at a time, it is also possible to erase all pieces of data, that is all of the patterns, at one time.

Further, in this preferred embodiment, the virtual erasing of the embroidery data selected to be erased is to erase reference to the data from the RAM 4 (S7). Accordingly, the stop processing to the virtual erasing is effected by copying all data from the flash memory card 10 to the RAM 4 again (S8: N; S1). However, the virtual erasing may be defined as erasing of only the display of the embroidery data selected to be erased with the embroidery data being left on the RAM 4, and the stop processing to the virtual erasing may be effected by recovering the display erased. In this case, the following process must be executed prior to the process of S10. That is, the virtually erased data, i.e., the data left on the RAM 4 but erased from the liquid crystal display 7, is actually erased from the RAM 4, and thereafter the remaining data left on the RAM 4 are relocated.

In preparing another flash memory card 10 storing only frequently usable data selected from many data stored in the flash memory card 10, the following process may be applied. That is, the flash memory card 10 storing many data is loaded into the flash memory device 5, and all data stored in the flash memory card 10 are copied to the RAM 4. After removing the flash memory card 10, all less frequently usable data are erased from the RAM 4. Thereafter, another flash memory card 10 is loaded into the flash memory device 5, and the contents of the RAM 4 are copied to this flash memory card 10.

What is claimed is:

1. An embroidery data storing device, comprising:

first storing means for storing a plurality of embroidery data;

erase data selecting means for selecting a plurality of embroidery data to be erased from the plurality of embroidery data stored in said first storing means;

virtually erasing means for virtually erasing the embroidery data selected by said erase data selecting means;

erase instructing means for instructing to actually erase the embroidery data virtually erased by said virtually erasing means;

collectively erasing means for collectively erasing all of the embroidery data virtually erased by said virtually erasing means when an erase instruction is made by said erase instructing means and display means for displaying identification of the plurality of embroidery data stored in said first storing means, wherein said display means discriminately displays identification of the embroidery data virtually erased and identification of the embroidery data not virtually erased, said display means highlighting display of the identification of the embroidery data virtually erased by said virtually erasing means, thereby discriminating the embroidery data virtually erased from the embroidery data not virtually erased.

2. The embroidery data storing device according to claim 1, further comprising:

virtual erase canceling means for canceling erase of the embroidery data virtually erased by said virtually erasing means, wherein identification of the embroidery data subjected to cancellation of the erase by said virtual erase canceling means is displayed in a format similar to that of the identification of the embroidery data not virtually erased.

3. The embroidery data storing device according to claim 1, wherein the identification displayed by said display means comprises a file number.

4. The embroidery data storing device according to claim 1, further comprising:

second storing means; and copying means for copying the plurality of embroidery data stored in said first storing means to said second storing means, wherein said virtually erasing means erases the embroidery data stored in said second storing means, which corresponds to the embroidery data selected by said erase selecting means, and said collectively erasing means includes writing means for writing to said first storing means the embroidery data stored in said second storing means according to an instruction by said erase instructing means.

5. The embroidery data storing device according to claim 4, further comprising virtual erase canceling means, wherein said virtual erase canceling means includes means for copying the plurality of embroidery data stored in said first storing means to said second storing means according to an instruction of cancellation of erase.

6. The embroidery data storing device according to claim 4, wherein said collectively erasing means initializes said first storing means according to the instruction by said erase instructing means and then writes the embroidery data stored in said second storing means the said first storing means.

7. The embroidery data storing device according to claim 6, wherein said first storing means comprises a flash memory and said second storing means comprises a RAM.

8. The embroidery data storing device according to claim 1, wherein said virtually erasing means erases the plurality of the embroidery data selected by said erase data selecting means one embroidery data at a time.

9. The embroidery data storing device according to claim 1, wherein said virtually erasing means erases all of the plurality of the embroidery data selected by said erase data selecting means at one time.

10. An embroidery data storing device, comprising:

a storage medium for storing a plurality of embroidery data;

a temporary memory;

a copying mechanism for copying the plurality of embroidery data stored in said storage medium to said temporary memory;

a data selecting device for selecting a plurality of embroidery data to be erased from the plurality of embroidery data stored in said storage medium;

an erasing mechanism for erasing the embroidery data copied to said temporary memory by said copying mechanism, which corresponds to the embroidery data selected by said data selecting device;

an instructing member for instructing erasure of the embroidery data stored in said storage medium which corresponds to the embroidery data erased by said erasing mechanism;

a writing mechanism includes an initializing mechanism for initializing said storage medium and for writing to said storage medium the embroidery data stored in said temporary memory according to an instruction by said instructing member and an erase canceling mechanism, wherein said erase canceling mechanism includes a writer for copying the plurality of embroidery data stored in said storage medium to said temporary memory according to an instruction of cancellation of erase.

11. The embroidery data storing device according to claim 10, further comprising:

a display for displaying identification of the plurality of embroidery data stored in said storage medium, wherein said display discriminately displays identification of the embroidery data erased in said temporary memory and identification of the embroidery data not erased.

12. The embroidery data storing device according to claim 11, wherein the identification displayed by said display comprises a file number and said display removes display of the file number of the embroidery data erased by said erasing mechanism, thereby discriminating the embroidery data erased from the embroidery data not erased.

13. The embroidery data storing device according to claim 10, wherein said storage medium comprises a flash memory, said temporary memory comprises a RAM.

14. A method of erasing embroidery pattern data from a recording medium, comprising the steps of:

copying all embroidery pattern data from the recording medium to a temporary memory in the reading device;

displaying a list of embroidery patterns that comprise the embroidery pattern data copied into the temporary memory;

designating specific embroidery patterns for erasure;

executing erasure of the specific embroidery patterns from the temporary memory; and writing embroidery pattern data of all embroidery patterns remaining in the temporary memory to the recording medium, the step of writing comprising the steps of:

initializing the recording medium; and copying all remaining embroidery pattern data to the recording medium; and optionally executing a canceling step prior to said writing step with said canceling step comprising the steps of stopping execution of any ongoing step;

recopying all embroidery pattern data from the recording medium to the temporary memory; and representing the list of embroidery patterns on the display.

* * * * *